US005381912A

United States Patent [19]

Walker et al.

[11] Patent Number: 5,381,912

[45] Date of Patent: Jan. 17, 1995

[54] PACKAGE HAVING A PRESS-AND-TURN TYPE CAP AND BOTTLE WITH RAMPED GRIPPING PORTIONS

[75] Inventors: Linda A. Walker, Hawthorne; Evan M. Hirsch, Emerson, both of N.J.

[73] Assignee: American Cyanamid Company, Wayne, N.J.

[21] Appl. No.: 234,893

[22] Filed: Apr. 28, 1994

[51] Int. Cl.[6] ..... B65D 55/02; B65D 41/00

[52] U.S. Cl. ..... 215/220; 215/295; 215/305; 215/16

[58] Field of Search ..... 215/217, 218, 219, 220, 215/221, 222, 295, 305, 329, 1 C, 11.1; 220/260, 670, 671, 673

[56] References Cited

U.S. PATENT DOCUMENTS

| | | | |
|---|---|---|---|
| D. 23,550 | 0/1894 | Bevan . | |
| D. 110,112 | 0/1936 | McIntosh . | |
| D. 113,332 | 0/1939 | Piluso . | |
| D. 113,394 | 0/1939 | Piluso . | |
| D. 124,623 | 0/1940 | Jung . | |
| D. 132,285 | 0/1942 | Sawyer . | |
| D. 152,625 | 0/1949 | Kronman . | |
| D. 156,193 | 0/1949 | Baron . | |
| D. 184,083 | 0/1958 | Crabbe . | |
| D. 191,181 | 0/1961 | Braun . | |
| D. 196,082 | 0/1963 | Stull . | |
| D. 208,508 | 0/1967 | Klein . | |
| D. 210,570 | 0/1968 | Campbell . | |
| D. 227,107 | 0/1973 | Bereson . | |
| D. 240,113 | 0/1976 | Conrad . | |
| D. 259,404 | 0/1981 | Jones . | |
| D. 274,887 | 0/1984 | Ryder . | |
| D. 280,291 | 0/1985 | Copsey . | |
| D. 321,649 | 0/1991 | Lambe . | |
| 3,055,524 | 9/1962 | Glasbrenner . | |
| 3,776,407 | 12/1973 | Cistone . | |
| 3,857,505 | 12/1974 | Mumford . | |
| 4,353,474 | 10/1982 | Luker | 215/220 |
| 4,997,096 | 3/1991 | Kusz | 215/201 |
| 5,020,681 | 6/1991 | Kusz | 215/220 |
| 5,072,884 | 12/1991 | Ellison et al. | 239/373 |

FOREIGN PATENT DOCUMENTS

| | | | |
|---|---|---|---|
| 100490 | 12/1940 | Sweden | 215/295 |
| 710781 | 6/1954 | United Kingdom | 215/295 |
| 856958 | 12/1960 | United Kingdom | 215/16 |

*Primary Examiner*—Allan N. Shoap
*Assistant Examiner*—Nova Stucker
*Attorney, Agent, or Firm*—Thomas S. Szatkowski

[57] ABSTRACT

An improved child-resistant package allowing improved access and closure by the user is provided. The improved packages is of the press-and-turn type and features ramped gripping portions on the perimeter of the side of the press-and-turn cap and on the bottle.

5 Claims, 3 Drawing Sheets

FIG. 1
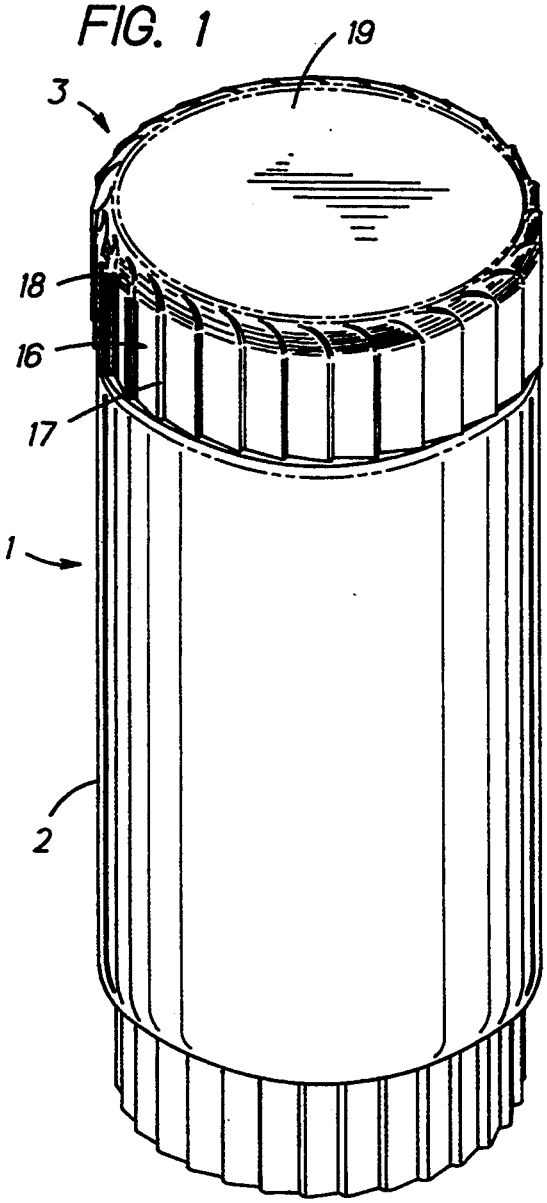
FIG. 2
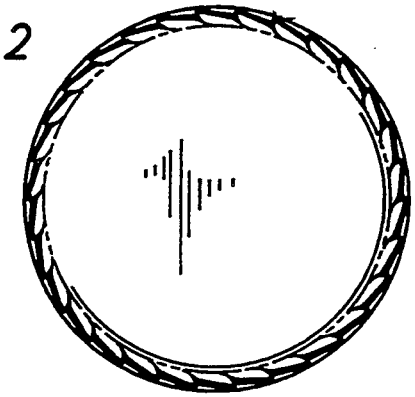
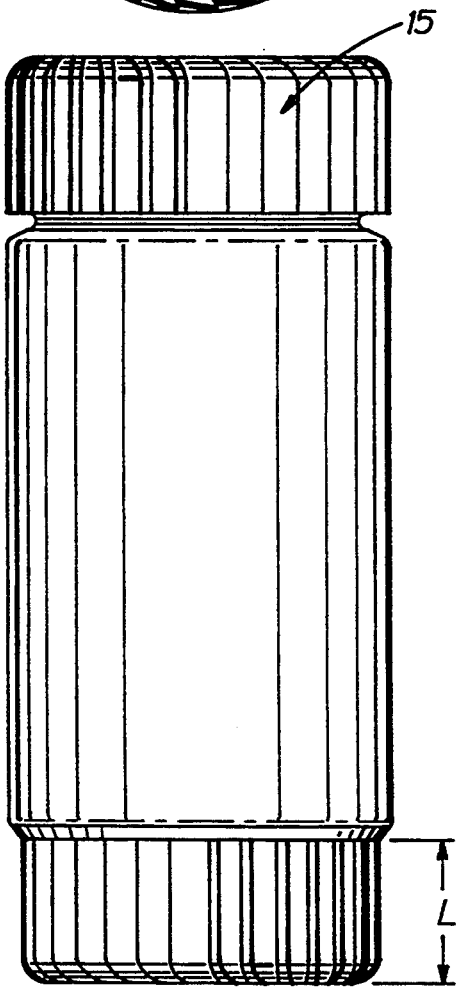
FIG. 3
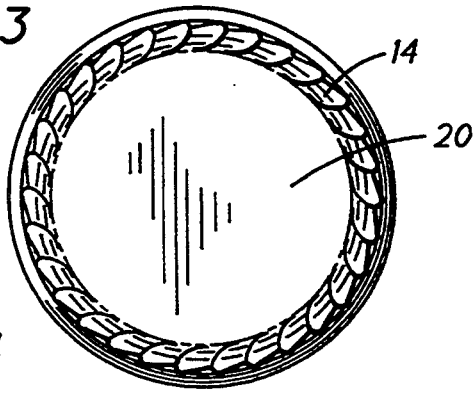
FIG. 4

PACKAGE HAVING A PRESS-AND-TURN TYPE CAP AND BOTTLE WITH RAMPED GRIPPING PORTIONS

FIELD OF THE INVENTION

The invention relates to an improved package having a press-and-turn type cap and bottle with ramped gripping portions at opposite ends thereof providing improved access and closure by the user, particularly the elderly.

SUMMARY OF THE INVENTION

The invention provides an improved package comprising:

a bottle having a neck defining an opening at one end thereof and a body having a recessed portion at the end opposite the opening, said recessed portion having a plurality of ramps disposed about the perimeter thereof, said bottle having thread means disposed on said neck;

a press-and-turn type cap having an inner shell engageable with said thread means of said bottle and an outer shell engaging with said inner shell by press-and-turn means, said outer shell having a plurality of ramps disposed about the perimeter of the side thereof, the ramps disposed on said cap facing opposite to the ramps disposed on said bottle.

DESCRIPTION OF THE DRAWINGS

FIG. 1 is a perspective view of the improved package of the present invention.

FIG. 2 is a top view of the improved package of the present invention.

FIG. 3 is a side view of the improved package of the present invention.

FIG. 4 is a bottom view of the improved package of the present invention.

DESCRIPTION OF THE PREFERRED EMBODIMENTS

Figure 5:
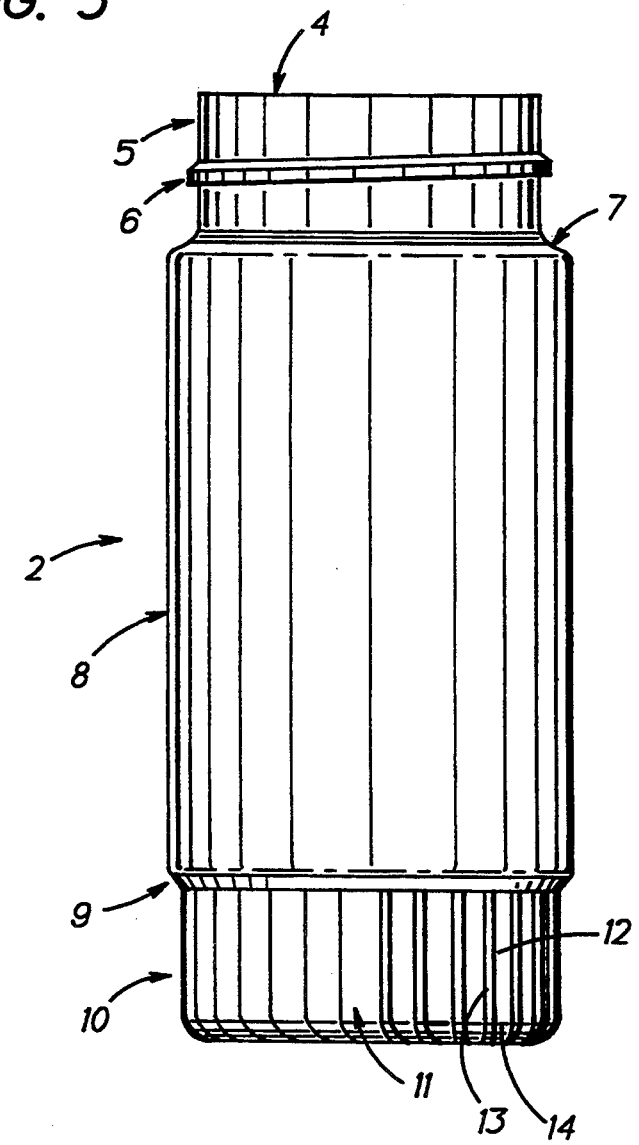
FIG. 5 is a side view of the bottle portion of the package of the present invention.
Figure 6:
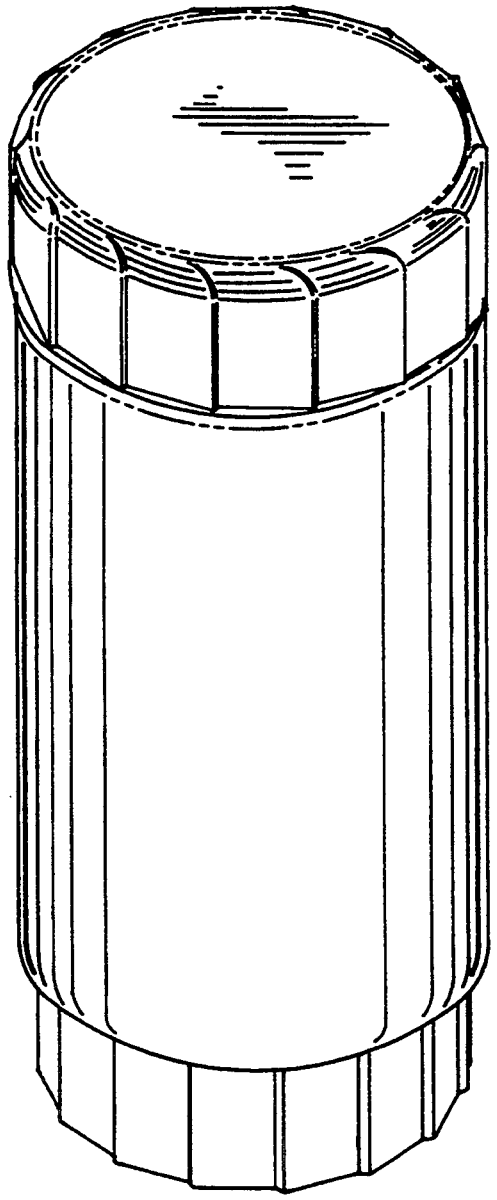
FIG. 6 is a perspective view of a second embodiment of the improved package of the present invention.

Older adults have great difficulty gaining access to child-resistant packages, especially those child-resistant packages featuring a push-and-turn type cap and bottle. As a result of the frustration with this type of package, many seniors purchase non-complying packages or deliberately disable or remove the child-resistant or feature. The Consumer Product Safety Commission has data showing that the ingestion of grandparents' medications is a significant contributing factor to child poisoning each year. (55 Fed. Reg. 40856 Oct. 5, 1990).

In order to address this problem, the Consumer Product Safety Commission has proposed a series of changes to the protocol tests used to evaluate child-resistant packaging for compliance. (Fed. Reg. Oct. 5, 1990, Mar. 5, 1991 and Mar. 21, 1994). By changing the age of the test population to 60–75 year old senior adults, and setting the pass criteria at 90%, child-resistant packaging should become more accessible to all adults.

Thus, use of child-resistant press-and-turn caps has been a historical problem for senior adults. Most of the efforts to alleviate this problem have been directed to the internal workings of the mechanism without addressing user ergonomics or the external configuration of the package to improve cap function.

By including a plurality of ramps about the perimeter of the exterior of the outer shell of the cap and about the perimeter of the bottom of the bottle, the improved package of the present invention functions in a more ergonomically improved fashion. Senior adults will therefore have better accessibility to the package on initial opening and will be able to properly re-close the package, preserving child-resistance and product integrity throughout its useful life. By lessening the frustration that older adults experience on the initial opening of the package, there is a much better chance of their using the package properly, rather than disabling or disposing of the child-resistant feature.

Referring to the figures, package 1 includes a cylindrical bottle portion 2 and a push-and-turn cap 3. Bottle portion 2 includes a cylindrical body 8, a mouth 4, and a neck portion 5 featuring raised threads adapted to the inner shell of the push-and-turn mechanism of cap 3. It will be appreciated by those skilled in the art that other equivalent bottle configurations, for example, polyhedron, may be utilized for the body portion of the improved package of the present invention. A shoulder 7 connects neck 5 to the cylindrical body 8. A bevel 9 leads to a recessed portion 10 located at the end of bottle 2 opposite the mouth 4. A plurality of ramps 11 are disposed completely about the circumference of the recessed portion 10 of bottle 2. It will be appreciated by those skilled in the art that such ramps may also be disposed intermittently, provided that a sufficient gripping area is afforded. Alternatively, the ramped portion could be disposed directly about the circumference of the cylindrical body of the bottle and not be located in a recessed portion.

Each ramp 11 is comprised of a face surface 12, a step or edge surface 13 and an arc-like transition surface 14 in which the face surface 12 and the step or edge surface 13 are merged into the bottom surface 20 of the bottle. Those skilled in the art will appreciate that other gripping means that serve to create gripping points equivalent to that provided by ramps 11 may also be utilized. It is contemplated that such other gripping means include prominent or substantial reliefs or ridges. The recessed portion 10 has a length L sufficient to provide a gripping area large enough to accommodate the adult hand sizes of a majority of the general population, i.e. to the 95th percentile. The recessed portion may be longer or shorter than that shown in the figures, however, it cannot be so short as to prohibit the users from obtaining a grip on the bottle 2.

Cap 3 is a push-and-turn type cap having an outer shell and an inner shell engaged by press-and-turn means. It will be appreciated by those skilled in the art that all push-and-turn devices of the type comprising an outer shell, an inner shell, and means to effect cooperation between the two shells to provide the push-and-turn effect may be utilized for the improved package of the present invention. Representative push-and-turn mechanisms, their design, parts, arrangement and operation of both the inner shell and outer shell, are to be found in U.S. Pat. Nos. 4,997,096, 3,055,524, 3,857,505, 5,020,681, 3,776,407, and 4,353,474, the contents of which are incorporated by reference.

One preferred press-and-turn engagement means comprises a series of vertical buttresses arrayed around the circumference of the inner shell. These buttresses mate with a vertical element of a pointed wedge arrayed around the inside circumference of the outer shell. When downward force is applied, the vertical elements engage the vertical buttresses and form a positive drive to facilitate the removal of the cap. Another representative press-and-turn engagement means utilizes an engagement design that locks together a vertical and angled surface or two angled surfaces. This allows the two surfaces to slip apart if insufficient downward force is applied. The higher the removal torque needed unscrew the cap, the higher the downward force needed engage the unscrewing device. Also, the two parts are not freewheeling, so a higher minimum torque may be required engage the child-resistant feature. It is contemplated that these and all other equivalent push-and-turn mechanisms De included within the scope of the improved package of the present invention. It is also contemplated that certain child-resistant mechanisms such as those of ASTM D3475 standard classification of child-resistant packages Type I, Type II and Type III, particularly: Type I (continuous thread) including Subtypes A&H (push-and-turn), B&C (squeeze-and-turn), F&G (lift-and-turn); Type II (lug finish) including Subtype A (push-and- turn); and Type III (snap closure including Subtype A (align and push up) be included within the scope of the improved package of the present invention.

The outer shell of cap 3 has a plurality of ramps 15 completely disposed about the circumference of the side of the cap. It will be appreciated by those skilled in the art that such ramps may also be disposed intermittently, provided that a sufficient gripping area is afforded. Each ramp is comprised of a face surface 16 and a step or edge surface 17 and an arc-like transition surface 18 in which the face surface 16 and the step or edge surface 17 are merged into the top surface 19 of the cap. Those skilled in the art will appreciate that other gripping means that serve to create gripping points equivalent to that provided by ramps 11 may also be utilized. It is contemplated that such other gripping means include prominent or substantial reliefs or ridges. It is desirable that the ramps in the cap 3 and in the recessed portion 10 of the bottle face in the opposite directions. In this regard, it is preferred that the edge or step surface 17 of the ramps 15 on the cap 3 face counterclockwise and that the edge or step surface 13 of the ramps 11 on the bottle 2 face clockwise when viewed from the top.

In evaluating how a press-and-turn closure works, and how to assist a person to open the package, it would seem that having the edge or step surface of the ramps facing in the unscrewing (clockwise when viewed from the top) direction on the cap would be of greatest value. Other considerations, however, especially automatic capping equipment, make such a configuration undesirable. In addition, when opening a press-and-turn closure, the unlocking mechanism is engaged by placing pressure on the top of the cap with the palm of the hand, not by grasping the sides of the cap as is done for most threaded closures. The unscrewing motion is provided more by twisting the bottle away from the cap than by turning the cap itself. In the recessed portion of the bottle, the edge or step surface of the ramps face in the clockwise (when viewed from the top) direction, providing a gripping portion when turning the bottle to open. When the unit is reclosed, the cap is grasped on the side and twisted with the fingers to retighten on the bottle. The edge or step surface of the ramps on the cap face counterclockwise (when viewed from the top) to facilitate the reclosing action. Alternating the direction of the ramps on the cap and bottle provides leverage to the hand through a series of gripping points that focus the opening and closing forces in both clockwise and counterclockwise directions as needed.

An improved package according to the present invention as depicted in FIG. 1 and having a plurality of ramps disposed about the circumference of the side of the outer shell of the cap in a counterclockwise direction (when viewed from the top) and a plurality of ramps disposed in a clockwise direction (when viewed from the top) about the circumference of a recessed portion at the bottom of the cylindrical bottle was tested in a Senior Adult Protocol Test for child-resistant packages against a standard push-and-turn type cap and bottle of the same size and having the same push-and-turn mechanism, but without the ramped gripping sections on either the cap or the bottle. The push-and-turn mechanism utilized was that sold by Sunbeam Plastics Corporation under the name FG. The improved package according to the present invention is referred to as the "ramped package" and the standard package without the ramped sections is referred to as the "stock package".

Two hundred older adults were tested in two separate panels of 100 participants in accordance with the Senior Adult Protocol cited below. To eliminate order bias, panelists were asked to open the stock package first or the ramped package first in no fixed order until a total of one hundred panelists of the correct age and sex distribution received each package first. Each panelist was presented with a package and given 5 minutes to open and reclose the container. At the end of 5 minutes, or when the first package of that style was opened and closed, the first package was removed and the panelist was given a second package of the same style to open and reclose in 1 minute. This procedure was repeated with the second package style. Opening times for both the first and second package of each style were recorded. The panelists were then asked questions on their preferences between the two package styles and requested to rate the two styles on a scale of 1 to 10, with 1 being the lowest and 10 being the highest rating.

All testing and data collection was done by an independent laboratory specializing in Consumer Product Safety Commission (CPSC) Protocol work. The testing was performed in accordance with Senior Adult and Child Protocols as published in the Federal Register, Vol. 56., No. 43, Mar. 5, 1991 and Federal Register, Vol. 59, No. 054, Mar. 21, 1994.

The opening times data and preference results and ratings were analyzed for statistical significance. The opening times were analyzed with a nonparametric sign test. See, for example, the book *Nonparametric Statistical Methods,* by Hollander and Wolfe (1973, Wiley). As is traditional, ties (equal ratings and opening times) were ignored.

All results reported below are statistically significant at the 5% level (p-value less than or equal to 0.05) unless otherwise noted; this means there is no greater than a 5% chance that the results observed are due to natural variation rather than a real effect. The lower the p-value the lower the chance the results are due to natural variation. The empirical data (opening times) and subjective data (ratings) show statistically significant improvements in performance, actual and perceived, of the ramped package over the stock package for the parameters measured.

Comparing the first and second opening times separately, the stock package took longer to open than the ramped package (p-value<0.001).

| Senior Adult Panel Results | |
|---|---|
| Average opening time | |
| Stock Package | 10.08 sec. |
| Ramped Package | 8.51 sec |
| Open time mid-range | |
| Stock Package | 6.00 sec. |
| Ramped Package | 4.00 sec. |

Five individuals failed to open the stock package on the first attempt, while all were able to open the ramped package on the first attempt; this is a statistically significant difference (p-value=0.03). One individual was unable to open the ramped package on the second attempt, and of those who successfully opened the stock package on the first attempt, three failed to open the stock package on the second attempt; not a statistically significant difference (p-value=0.30). The difference in failures to open was tested, due to the small number of failures, using an exact test of binomial proportions; see, for example, Appendix I (31) in the book *Quality Control and Industrial Statistics,* 4th de., by Duncan (1974, Irwin).

| Failures to open | 1st Opening | 2nd opening | Total |
|---|---|---|---|
| Stock Package | 5 | 3 | 8 |
| Ramped Package | 0 | 1 | 1 |

Each Failure was a different panelist.

| Total Packages Tested | |
|---|---|
| Stock Package | 395 |
| Ramped Package | 399 |
| Total Panelists | |
| Stock Package | 200 |
| Ramped Package | 200 |

Each panelist was asked to rate the two packages on a scale of 1 to 10. The ramped package received better ratings than the stock package (p-value<0.01). Out of 200 panelists, 141 ranked the packages differently with 107 rating the ramped package higher. These data were analyzed with the nonparametric sign test cited above.

In addition to the rating data, each panelist was asked to state a preference between the stock and ramp package (or give no preference) on appearance, performance and overall preference. Of those expressing a preference, a proportion statistically greater than 50% preferred the ramped package over the stock package on all three parameters. The standard method for constructing a 95% confidence interval for a binomial proportion was used for this analysis.

A larger size of the improved package according to the present invention was also tested as per Federal Register, Vol. 59, No. 054, Mar. 21, 1994 with a calculated Senior Adult Use Effectiveness of 100%.

We claim:

1. An improved package comprising:

a bottle having a neck defining an opening at one end thereof and a body having a recessed portion at the end opposite the opening, said recessed portion having a plurality of ramps disposed about the perimeter thereof said bottle having thread means disposed on said neck;

a press-and-turn type cap having an inner shell engageable with said thread means and an outer shell engaging with said inner shell by press-and-turn means, said outer shell having a plurality of ramps disposed about the perimeter of the side thereof, the ramps disposed on said cap facing opposite to the ramps disposed on said bottle.

2. The package of claim 1 where said ramps on said cap face in a counterclockwise direction and said ramps on said bottle face in a clockwise direction.

3. The package of claim 1 wherein said bottle is cylindrical.

4. The package of claim 1 wherein said ramps are completely disposed about the perimeter of the bottle and cap.

5. The package of claim 1 wherein said ramps are intermittently disposed about the perimeter of the bottle and cap.

* * * * *